US006593921B2

(12) United States Patent
Nakanishi et al.

(10) Patent No.: US 6,593,921 B2
(45) Date of Patent: Jul. 15, 2003

(54) SYSTEM AND METHOD FOR ADJUSTING IMAGE QUALITY OF LIQUID CRYSTAL DISPLAY

(75) Inventors: Kunifumi Nakanishi, Kumamoto (JP); Shuji Nishizaki, Kumamoto (JP); Akitoshi Miyaoka, Kumamoto (JP); Yoshimi Kinoshita, Tokyo (JP); Yoshikazu Ikuta, Tokyo (JP)

(73) Assignees: Kabushiki Kaisha Advanced Display, Kumamoto (JP); Mitsubishi Denki Kabushiki Kaisha, Tokyo (JP)

( * ) Notice: Subject to any disclaimer, the term of this patent is extended or adjusted under 35 U.S.C. 154(b) by 150 days.

(21) Appl. No.: 09/759,368

(22) Filed: Jan. 16, 2001

(65) Prior Publication Data

US 2001/0015725 A1 Aug. 23, 2001

(30) Foreign Application Priority Data

Jan. 18, 2000 (JP) ..... 2000-008669

(51) Int. Cl.[7] ..... G09G 5/00

(52) U.S. Cl. ..... 345/208; 345/94; 345/87; 348/184; 324/770

(58) Field of Search ..... 345/166, 87, 94, 345/208, 207; 349/86; 348/188, 180, 184, 185, 186, 191; 324/770

(56) References Cited

U.S. PATENT DOCUMENTS 4,761,685 A * 8/1988 Asaida et al. ..... 348/188
5,075,539 A * 12/1991 Shiraishi ..... 250/208.1
5,351,201 A * 9/1994 Harshbarger, Jr. et al. .. 348/187
5,748,273 A * 5/1998 Okabe ..... 349/86
6,269,482 B1 * 7/2001 Gershfeld ..... 348/181

FOREIGN PATENT DOCUMENTS

JP 1-269991 10/1989

* cited by examiner

*Primary Examiner*—Steven Saras
*Assistant Examiner*—Fritz Alphonse
(74) *Attorney, Agent, or Firm*—McDermott, Will & Emery

(57) ABSTRACT

With the prior art image-adjusting system for a liquid crystal display, flicker is adjusted by operator's visual examination and so human factors vary the potential-adjusting value applied to the common electrode. The invention provides an image-adjusting system and method free of this problem. The image-adjusting method starts with placing optical sensors opposite to a given location on a liquid crystal display. The output waveform from the optical sensors is observed on an oscilloscope in synchronism with the vertical synchronizing signal that is synchronized to odd frames or even frames. The potential applied to the common electrode of the liquid crystal display is shifted upward from the optimum potential to observe a first waveform. The potential on the common electrode is shifted downward from the optimum potential to observe a second waveform. The potential Vcom applied to a liquid crystal display to be adjusted is so adjusted that the waveform derived from the liquid crystal display to be adjusted has a phase midway between the phases of the previously obtained first and second waveforms.

8 Claims, 8 Drawing Sheets

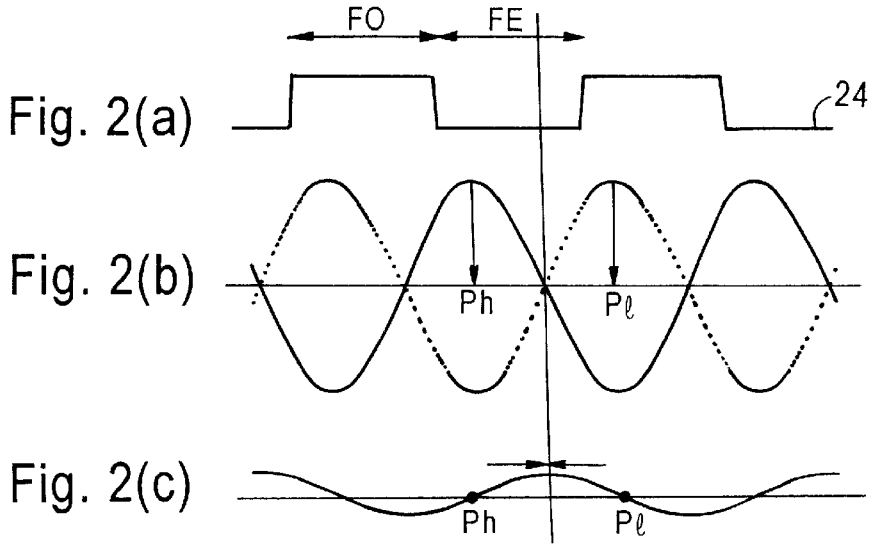
FO
FE
Fig. 2(a)
24
Fig. 2(b)
Ph
Pℓ
Fig. 2(c)
Ph
Pℓ
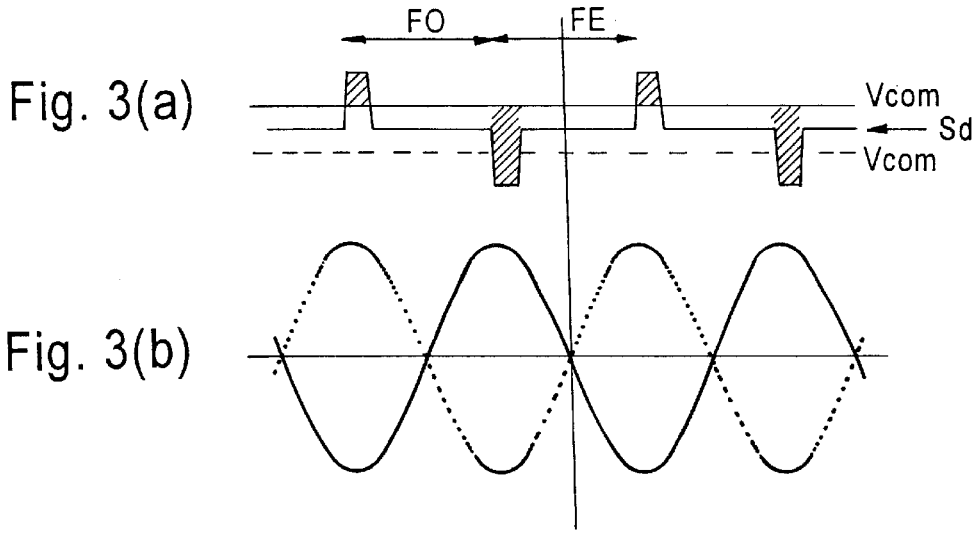
FO
FE
Fig. 3(a)
Vcom
Sd
Vcom
Fig. 3(b)

Vcom is high

Vcom is somewhat high

Vcom is optimal

Vcom is somewhat low

Vcom is low

SYSTEM AND METHOD FOR ADJUSTING IMAGE QUALITY OF LIQUID CRYSTAL DISPLAY

BACKGROUND OF THE INVENTION

1. Field of the Invention

The present invention relates to a system and method for adjusting the image quality of a liquid crystal display by adjusting the potential on the common electrode in such a way as to reduce flicker (i.e., fluctuation of brightness) produced on the viewing screen of the liquid crystal display.

2. Description of the Related Art

FIG. 10 is a block diagram of the prior art driver circuit for a liquid crystal display. Shown in this figure are a liquid crystal panel 1 consisting of two glass substrates and a liquid crystal material sandwiched between the glass substrates, a signal-side driver IC 2 for driving the liquid crystal panel 1, a scanning-side driver IC 3 for driving the liquid crystal panel 1, and a control circuit 4 for supplying control signals to the signal-side driver IC 2 and to the scanning-side driver IC 3. The control circuit 4 also supplies a scanning signal 5 and a display signal 6. A large number of pixels for making up an image are arranged in rows and columns on the liquid crystal panel 1. FIG. 11 is an enlarged view of some pixels.

FIG. 11 is a diagram illustrating the configuration of pixels of the prior art liquid crystal panel. Shown in this figure are scanning signal lines 7 connected with the scanning-side driver IC 3, display signal lines 8 connected with the signal-side driver IC 2, switching elements 9 such as TFTs placed at the intersections of the scanning signal lines 7 and the display signal lines 8, and pixel electrodes 10 connected with the switching elements 9.

FIG. 12 is a cross-sectional view of the prior art liquid crystal panel, illustrating the cross-sectional structure of pixels. Shown in this figure are an array substrate 11 that is a first substrate, a counter substrate 12 that is a second substrate and located opposite to the array substrate 11, a common electrode 14 formed over the whole surface of the counter substrate 12, and a liquid crystal material 15 sealingly sandwiched between the array substrate 11 and the counter substrate 12. The first and second substrates 11 and 12 are made of glass. The pixel electrodes 10 are formed at individual pixels on the array substrate 11. The scanning signal lines 7, the display signal lines 8, and the switching elements 9 are also formed on the array substrate 11.

FIG. 13 is a diagram illustrating the waveforms of the display signal on each display electrode and of the potential on the common electrode of the prior art liquid crystal display. The display signal on the pixel electrode 10 is indicated by 6. The potential Vcom applied to the common electrode 14 is indicated by 16. The display signal 6 and the potential Vcom 16 shown in FIG. 13 are waveforms associated with one pixel. In FIG. 13, FO is an odd frame and FE is an even frame.

In the liquid crystal display of the construction as described above, the display signal is generally inverted in polarity every frame period at about 60 Hz to prevent the liquid crystal material from deteriorating due to aging. If the voltage applied to the liquid crystal material agrees with the center about which the polarity is inverted like the potential Vcom 16*a* shown in FIG. 13, the voltage applied to the liquid crystal material is constant with time. However, if the voltage deviates like potential Vcom 16*b*, and if the voltage value of an AC signal applied to the layer of the liquid-crystal material differs between when the polarity is positive and when it is negative, flicker (i.e., fluctuation of brightness) occurs at about 30 Hz.

To eliminate this flicker, it is necessary to adjust the level of the potential Vcom so that the voltage applied to the liquid crystal material does not differ between when the polarity is positive and when it is negative. In particular, an image producing easily discernible flicker is displayed on the viewing screen. Then, the operator adjusts the Vcom-adjusting knob mounted on the liquid crystal display, whereby the degree of flicker observed with the naked eye is minimized.

With this method, human factors vary the adjusted value of the potential Vcom. Accordingly, as shown in FIG. 14, another method uses an optical sensor in a certain location on the viewing screen. The resulting electrical signal waveform is observed. An adjustment is made to minimize the amplitude.

FIG. 14 is a block diagram showing the prior art image quality-adjusting system. The aforementioned optical sensor, indicated by numeral 17, is positioned opposite to a liquid crystal panel 1 and produces an electrical signal corresponding to the amount of light that the sensor receives. The output signal from the optical sensor 17 is amplified by an amplifier 18. A band-pass filter 19 is located on the output side of the amplifier 18 and detects a flicker signal component. The flicker signal from the band-pass filter 19 is indicated by 20. An oscilloscope 21 is used to observe the flicker signal 20. An image signal generator 22 produces an image display signal 23 to the liquid crystal panel 1.

A method disclosed in Japanese Patent Laid-Open No. 269991/1989 uses an optical sensor mounted opposite to a liquid crystal panel, a rectifier circuit for rectifying the output signal from the sensor that is in proportion to the light impinging on the sensor, and a low-pass filter for smoothing the rectifier output from the rectifier circuit and producing an output signal indicating the deviation from the optimum value of the potential on the common electrode. This method enables accurate adjustment.

In the above-described method using operator's visual observation to make an adjustment for minimizing flicker, human factors vary the adjusted value of the potential Vcom. Especially, where the display screen is large, an optimum value of the potential Vcom at which flicker is minimized differs from location to location on the viewing screen. It is highly likely that the position at which an adjustment is made to minimize flicker varies, depending on the worker. As a result, fabricated products differ in performance.

Furthermore, the worker must watch flicker of high optical intensity for a long time. This may adversely affect the human body psychologically and physically.

In one of the above-described methods, the optical sensor located at some location on the viewing screen is used, the resulting electrical signal waveform is observed, and an adjustment is made to minimize the amplitude. In this method, the magnitude of the observed waveform differs according to the magnitude of the brightness of backlight and so it is difficult to detect the minimum value of the amplitude. Especially, immediately after the backlight is turned on, the brightness varies violently, thus deteriorating the efficiency of operation greatly.

Furthermore, the method disclosed in the above-cited Japanese Patent Laid-Open No. 269991/1989 makes use of the principle that the magnitude of a signal corresponding to the brightness is minimized. Therefore, the adjustment is directly affected by the brightness of backlight in the same way as in the above-described method.

In a further method, an adjustment is made with a frequency analyzer to minimize the frequency component corresponding to flicker. This method needs expensive apparatus. In addition, the response of the observed signal is slow. Hence, the efficiency of operation is poor.

SUMMARY OF THE INVENTION

The present invention has been made to solve the foregoing problems.

It is an object of the present invention to provide an image quality-adjusting system for a liquid crystal display, the system permitting one to adjust potential Vcom with high accuracy and high reproducibility for minimizing flicker.

An image quality-adjusting system for a liquid crystal display in accordance with the present invention comprises at least one optical sensor located opposite to a given location on a liquid crystal panel and an oscilloscope synchronized to a vertical synchronizing signal that is synchronized to odd frames or even frames. The optical sensor produces an output signal corresponding to the amount of light impinging on the sensor. The oscilloscope is used to observe the waveform of the electrical output signal from the optical sensor. A sufficiently high potential is previously applied to the common electrode of the liquid crystal display to observe a first waveform on the oscilloscope. Also, a sufficiently low potential is previously applied to the common electrode to observe a second waveform on the oscilloscope. The potential applied to the common electrode of a liquid crystal display to be adjusted is so adjusted that the waveform derived from this liquid crystal display and observed on the oscilloscope has a phase midway between the phase of the first waveform and the phase of the second waveform.

In one feature of the invention, the aforementioned at least one optical sensor consists of plural optical sensors. The resulting waveform of the electrical signals from the optical sensors is observed on the oscilloscope.

In another feature of the invention, the optical sensors are located on the same scanning signal line.

The plural optical sensors are positioned at least in a first measurement point and in a second measurement point. In the first measurement point, an adjusted value greater than a previously obtained, adjusted value of potential applied to the common electrode is derived. The previously obtained, adjusted value has been previously obtained by visual examination. In the second measurement point, an adjusted value smaller than a previously obtained, adjusted value of potential applied to the common electrode is derived.

In a further feature of the invention, at least one of the optical sensors detects the amount of received light via an optical attenuation filter.

In a yet other feature of the invention, an attenuation circuit is connected with the output of at least one of the optical sensors.

In an additional feature of the invention, the attenuation circuit has a variable attenuation factor.

The invention also provides a method of adjusting the image quality of a liquid crystal display, the method starting with setting the potential applied to the common electrode to a high value. Then, electrical signals from optical sensors located opposite to a given location on a liquid crystal panel are observed as a first waveform on an oscilloscope in synchronism with a vertical synchronizing signal that is synchronized to odd frames or even frames. The potential applied to the common electrode of the liquid crystal display is set to a sufficiently low value. The electrical signals from the optical sensors are observed as a second waveform on the oscilloscope. The optical sensors are placed opposite to a given position on the liquid crystal panel of a liquid crystal display to be adjusted. Then, the potential applied to the common electrode is adjusted such that the waveform of the electrical signals from the optical sensors observed on the oscilloscope has a phase midway between the phase of the first waveform and the phase of the second waveform, the optical sensors being located opposite to the liquid crystal display to be adjusted.

Other objects and features of the invention will appear in the course of the description thereof, which follows.

BRIEF DESCRIPTION OF THE DRAWINGS

FIG. 2 is a diagram of waveforms observed on the image quality-adjusting system in accordance with embodiment 1 of the invention;

FIG. 3 is a diagram of waveforms illustrating the principle of operation of the image quality-adjusting system in accordance with embodiment 1 of the invention;

DESCRIPTION OF THE PREFERRED EMBODIMENTS

Embodiment 1

Figure 1:
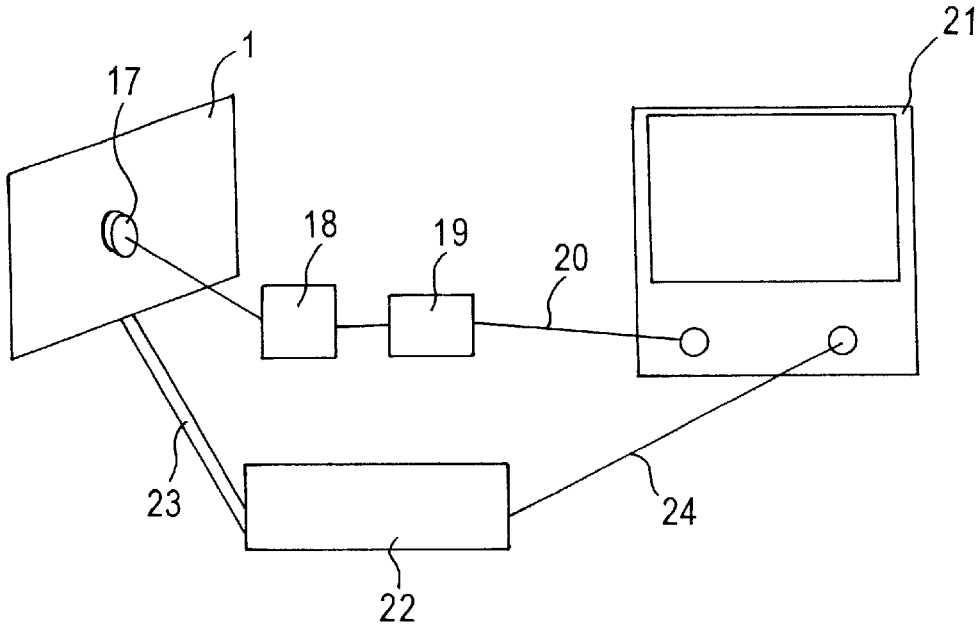
FIG. 1 is a block diagram of an image quality-adjusting system in accordance with embodiment 1 of the present invention.
Figure 4A:
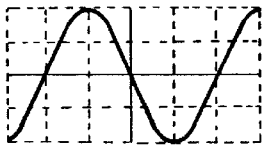
FIG. 4 is a diagram of waveforms observed on the image quality-adjusting system in accordance with embodiment 1 of the invention.
Figure 4B:
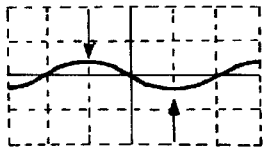
Figure 4C:
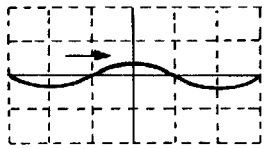
Figure 4D:
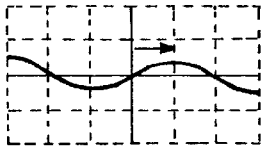
Figure 4E:
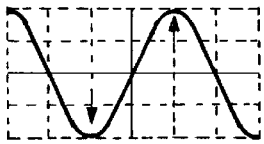

FIG. 1 is a diagram showing an image-adjusting system in accordance with embodiment 1 of the present invention. Shown in FIG. 1 are a liquid crystal panel 1 and an optical sensor 17 placed opposite to the liquid crystal panel 1 and producing an electrical signal corresponding to the amount of light impinging on the sensor. The output signal from the optical sensor is amplified by an amplifier 18. A band-pass filter 19 is located on the output side of the amplifier 18 and detects a flicker signal component. The flicker signal from the band-pass filter 19 is indicated by 20. An oscilloscope 21 is used to observe the flicker signal 20. An image signal generator 22 produces an image display signal 23 to the liquid crystal panel 1. A vertical synchronizing signal 24 is produced by the image signal generator 22, has a frequency of about 30 Hz, is synchronized to odd frames or even frames, and is fed to the oscilloscope 21.

FIG. 2 is a diagram illustrating waveforms observed on the image quality-adjusting system in accordance with embodiment 1 of the present invention. The waveform of the vertical synchronizing signal synchronized to odd frames FO or even frames FE is shown at (a) of FIG. 2. The waveforms of optical responses observed on the oscilloscope 21 are shown at (b) and (c) of FIG. 2.

In FIG. 2, the vertical synchronizing signal is indicated by reference numeral 24. The position of a waveform (herein referred to as the first waveform) obtained when the potential Vcom is shifted upward greatly from the optimum potential Vcom is indicated by Ph. The position of a waveform (herein referred to as the second waveform) obtained when the potential Vcom is shifted downward greatly from the optimum potential Vcom is indicated by Pl.

FIG. 3 is a diagram showing observed waveforms, illustrating the principle of operation of the image quality-adjusting system in accordance with embodiment 1 of the invention. The relation between the display signal Sd and the potential Vcom is illustrated at (a) of FIG. 3. The waveform shown at (b) corresponds to the waveform shown at (a) of FIG. 3, and depicts an optical response waveform observed on the oscilloscope 21.

Figure 11:
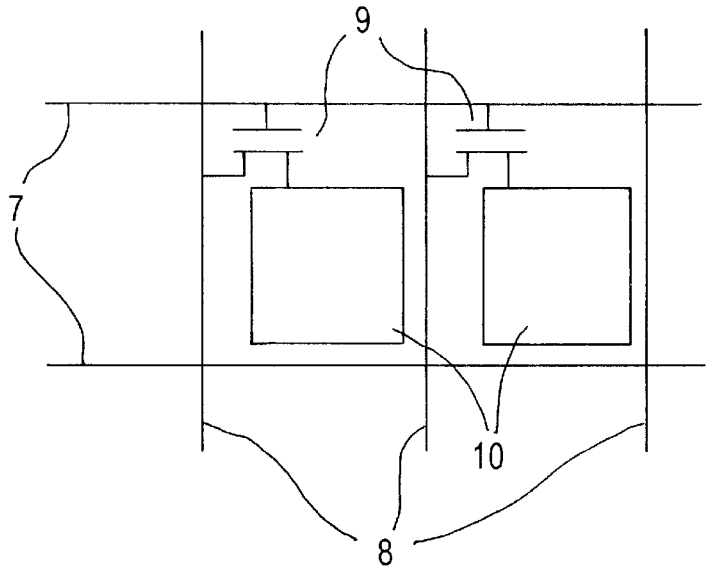
Fig. 11 PRIOR ART
FIG. 11 is a view showing the configuration of pixels of the prior art liquid crystal panel.
Figure 12:
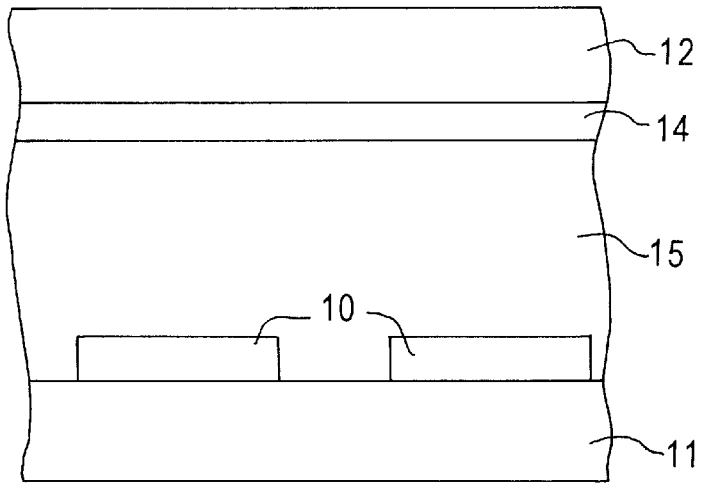
Fig. 12 PRIOR ART
FIG. 12 is a cross-sectional view of the prior art liquid crystal panel, showing the structure of pixels.
Figure 13:
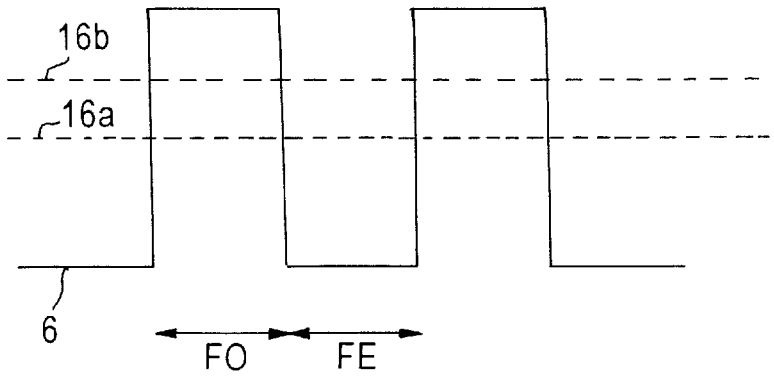
Fig. 13 PRIOR ART
FIG. 13 is a diagram showing the waveform of a display signal on a pixel electrode of the prior art liquid crystal display and the waveform of the potential on the common electrode.
Figure 14:
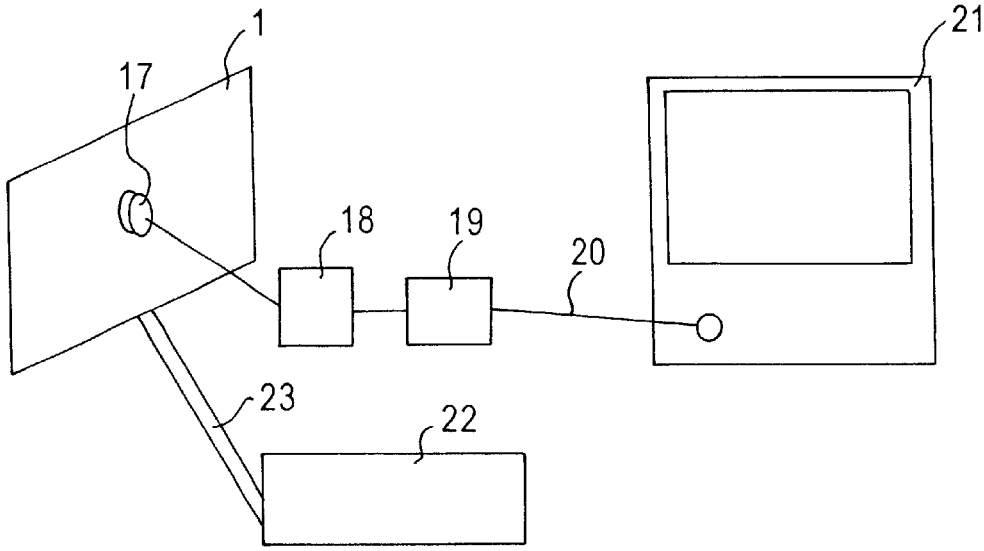
Fig. 14 PRIOR ART
FIG. 14 is a block diagram of the prior art image quality-adjusting system.

FIG. 4 shows waveforms observed with the image-adjusting system in accordance with embodiment 1 of the invention. The waveform observed when the potential Vcom is high is shown at (a). The waveform observed when the potential Vcom is somewhat is high is shown at (b). The waveform observed when the potential Vcom is optimal is shown at (c). The waveform observed when the potential Vcom is somewhat low is shown at (d). The waveform observed when the potential Vcom is low is shown at (e). The pixels of the liquid crystal panel 1 have the same structure as the prior art structure already described in connection with FIGS. 11 and 12 and will not be described below.

The operation of the image quality-adjusting system is now described. The optical sensor 17 is placed opposite to a given position on the viewing screen of the liquid crystal panel 1, as shown in FIG. 1. Flicker waveform 20 produced from the sensor 17 is observed on the oscilloscope 21.

At this time, the waveform observation is triggered by the vertical synchronizing signal 24 synchronized to the odd frames or even frames as shown at (a) of FIG. 2, the vertical synchronizing signal 24 being included in driver signals for the liquid crystal display.

An operator adjusts the Vcom-adjusting knob of the liquid crystal display. The potential is shifted upward sufficiently greatly from the optimum potential Vcom, and the resulting waveform is observed as shown at (b) of FIG. 2. This position (phase) is indicated by Ph, and this process step is referred to as the first step. Then, the potential is shifted downward greatly from the optimum potential. This position (phase) is indicated by Pl, and this process step is referred to as the second step. In this way, the two phases are previously found and checked. The phase difference between them is always 180°.

Then, a liquid crystal display that should be adjusted to minimize flicker and may be different from the liquid crystal display used to check the waveform positions Ph and Pl described above is placed in position as shown in FIG. 1. This process step is referred to as the third step. Then, flicker waveform is observed.

The Vcom-adjusting knob of the liquid crystal display placed in position is adjusted such that the flicker waveform has a phase midway between the phase in the waveform position Ph and the phase in the waveform position Pl. This process step is referred to as the fourth step. In this manner, an optimum potential Vcom is obtained.

When synchronization is made using the vertical synchronizing signal shown at (a) of FIG. 2, the phase of the flicker waveform 20 moves from −90° to +90° across the optimum potential Vcom. Embodiment 1 utilizes this phenomenon. This is described in further detail below.

The relation between the display signal at some pixel and the potential Vcom is illustrated at (a) of FIG. 3. The solid line indicates the waveform obtained when the potential Vcom is shifted upward from the optimum potential Vcom. The broken line indicates the waveform produced when the potential Vcom is shifted downward from the optimum potential Vcom. Where the potential Vcom is shifted upward from the optimum potential Vcom, the voltage applied to each pixel becomes lower during odd frames and higher during even frames as indicated by hatching. The optical response waveform observed with the oscilloscope 21 is indicated by the solid line at (b) of FIG. 3. In the case of a general, normally white liquid crystal display, it becomes brighter with reducing the applied voltage. The liquid crystal material shows optical response after a given delay from the application of the voltage. Therefore, the optical response waveform gradually increases after a signal is written during each odd frame as indicated by the solid line at (b) of FIG. 3. The waveform gradually decreases after each even frame.

An optical waveform obtained when the potential Vcom is shifted in the reverse direction, i.e., downward, from the optimum potential Vcom is indicated by the broken line at (b) of FIG. 3. The phase difference between when the potential Vcom is higher than the optimum potential Vcom and when the potential Vcom is lower than the optimum potential Vcom is 180°.

FIG. 4 shows flicker waveform obtained when the potential Vcom that is higher than the optimum potential Vcom is brought close to the optimum potential Vcom and reduced across the optimum potential.

Where the potential Vcom is close to the optimum potential Vcom, the amplitude is small as shown at (b) of FIG. 4. Also, the phase begins to deviate. At the optimum potential Vcom, the phase is shifted by 90° as shown at (c) of FIG. 4, because when the 30-Hz component of the flicker decreases, 60-Hz component by the effect of writing/holding characteristics of TFTs is detected, and because the flicker detection area of the optical sensor is finite. If the potential is reduced below the optimum potential Vcom, the phase is further shifted by 90° as shown at (d) of FIG. 4.

Where the image-quality adjusting system in accordance with embodiment 1 is used, the optimum potential Vcom at which flicker is minimized can be set with high accuracy and high reproducibility.

Furthermore, an adjustment is made to minimize the flicker without being affected by the brightness of the backlight. In addition, the adjustment for minimizing the flicker is made without viewing flicker on the viewing screen and so the human body is not adversely affected. Moreover, the adjustment is performed while visually checking the movement of waveform and, therefore, the efficiency of operation is improved.

Embodiment 2

Figure 5:
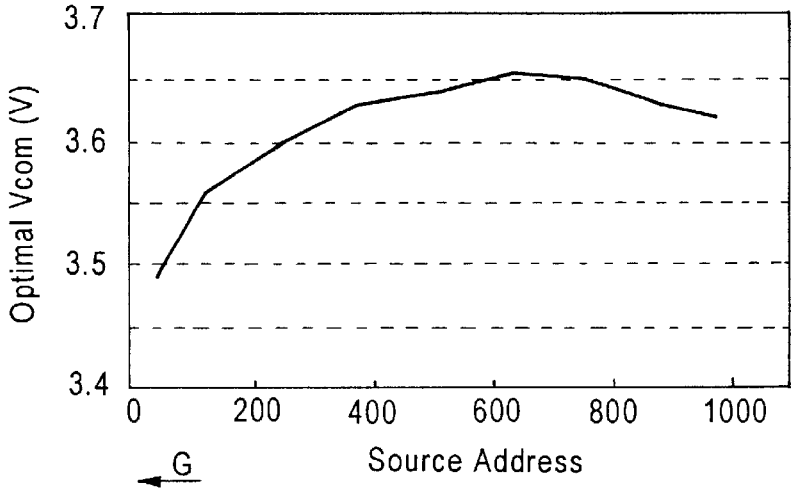
FIG. 5 is a graph showing the horizontal distribution of optimum potential Vcom of a general liquid crystal display.
Figure 6:
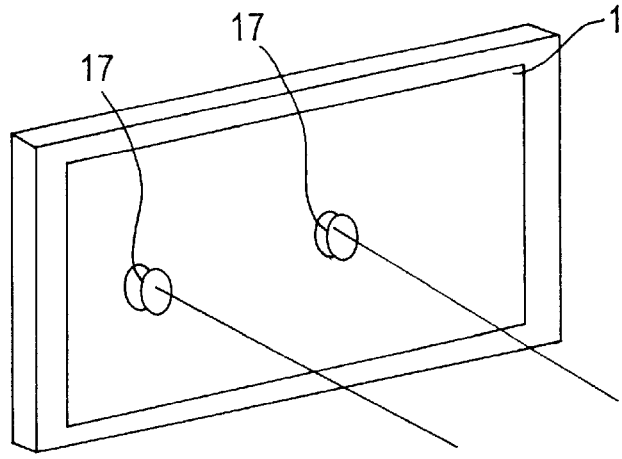
FIG. 6 is a fragmentary perspective view of an image quality-adjusting system in accordance with embodiment 2 of the invention.
Figure 7:
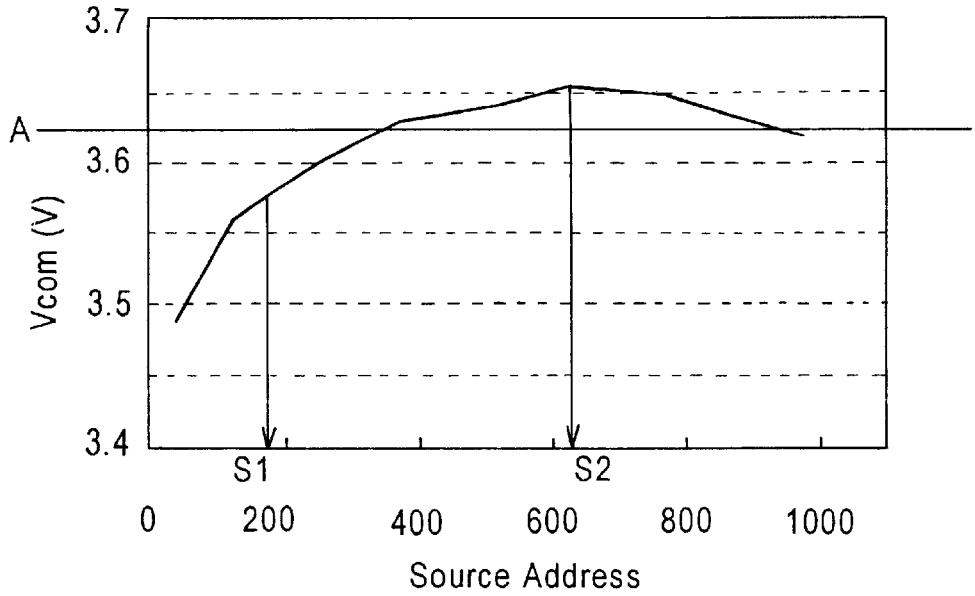
FIG. 7 is a graph showing the horizontal distribution of optimum potential Vcom of a liquid crystal display in accordance with embodiment 2 of the invention.

FIG. 5 is a graph showing the horizontal distribution of optimum potential Vcom of a general liquid crystal display. FIG. 6 is a fragmentary perspective view of an image-adjusting system in accordance with embodiment 2 of the invention. In FIG. 6, the same liquid crystal display 1 is shown as in FIG. 1. However, in FIG. 6, two optical sensors 17 are mounted in locations spaced from each other on the liquid crystal panel 1. FIG. 7 is a graph showing the horizontal distribution of optimum potential Vcom on the liquid crystal display in accordance with embodiment 2 of the invention.

In embodiment 1, flicker is detected at one location. In contrast, in embodiment 2, flicker is detected at plural locations. In an actual liquid crystal display, the optimum potential Vcom is not constant but has a distribution across the viewing screen.

FIG. 5 shows one example of horizontal distribution of optimum potential Vcom taken along one scanning signal line within the viewing screen. Generally, the optimum potential Vcom on the input side of the scanning signal is low and increases with going away from the input side. In particular, as the distance from the input side of scanning signal increases, the scanning signal is distorted to a greater extent by delay of the signal, and the effect of the scanning signal determining the optimum potential Vcom and the effect of the pixel electrode on the coupling capacitance decrease. In FIG. 5, an arrow G shows the input side of gate signal.

To cope with this in-plane distribution of optimum potential Vcom, the two optical sensors 17 are placed substantially on the same scanning signal line within the viewing screen of the liquid crystal panel 1, as shown in FIG. 6. For example, in FIG. 7, if the value of the optimum potential Vcom obtained by visual examination and adjustment is at A, the positions of the optical sensors 17 are so set that the adjusted optimum potential Vcom lies at the first measurement point S1 and the second measurement point S2, respectively, that are on the opposite sides of the point A. The waveform observed on the oscilloscope 21 is the combination of the flicker waveform at the measurement point S1 and the flicker waveform at the measurement point S2. The optimum potential Vcom is detected in the same way as in the case using one optical sensor. The potential Vcom found in this way is the average value of optimum potentials Vcom at the plural measurement points.

In the description above, the number of the optical sensors 17 is two. Three or more optical sensors may be used according to the size of the viewing screen or the distribution of optimum potential Vcom.

In embodiment 2, the plural optical sensors 17 are placed on the same scanning signal line. This assures that the positional relations of the flicker waveforms (i.e., waveform positions Ph and Pl at (b) of FIG. 2) to the vertical synchronizing signal are made common to the optical sensors 17. Consequently, the waveforms can be easily synthesized into one.

Embodiment 2 permits fabrication of an image quality-adjusting system producing adjustment results well coincident with the results of adjustment of the optimum potential Vcom utilizing visual observation where the liquid crystal display has a large viewing screen within which the optimum potential Vcom is distributed.

Embodiment 3

Figure 8:
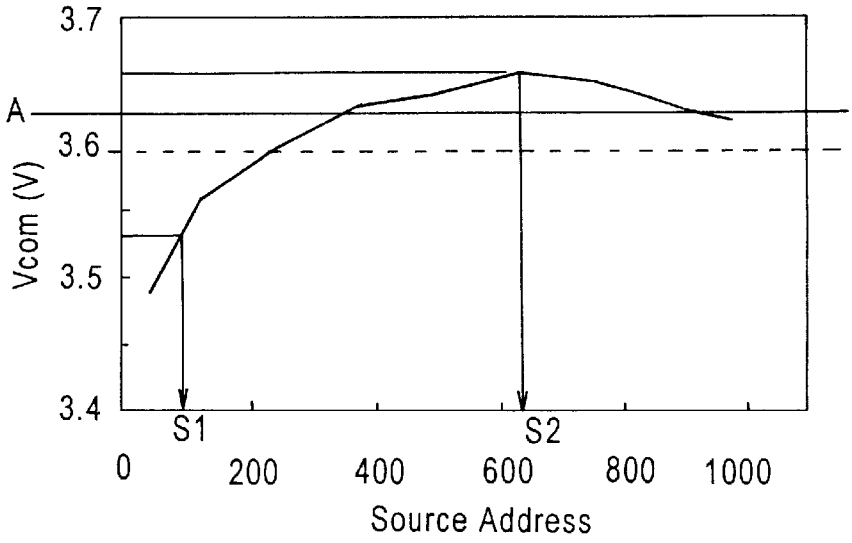
FIG. 8 is a graph showing the horizontal distribution of optimum potential Vcom of a liquid crystal display in accordance with embodiment 3 of the invention.

FIG. 8 is a graph showing the horizontal distribution of the optimum potential Vcom on a liquid crystal display in accordance with embodiment 3 of the invention. Embodiment 3 is similar to embodiment 2 except that at least one of the plural optical sensors has an optical attenuation filter to attenuate the light going out of the sensor by a given amount. Thus, the optical sensors are weighted.

Two optical sensors are placed in the measurement points S1 and S2, respectively. As an example, an optical attenuation filter is installed in the optical filter located in the measurement point S1. The optimum potential Vcom adjusted by the present method is indicated in FIG. 8. The broken line indicates the optimum potential Vcom adjusted where the output signal from the sensor is not passed through the attenuation filter. This adjusted value is the mean value of the optimum potential Vcom in the measurement point S1 and the optimum potential Vcom in the measurement point S2. On the other hand, the solid line A indicates the optimum potential Vcom adjusted using the combination of flicker waveforms from the two optical sensors similarly to embodiment 2 but an optical attenuation filter is positioned in the measurement point S1, to weight the potential Vcom in the measurement point S2. The value adjusted in this way is closer to the optimum potential Vcom in the measurement point S2, the optimum potential being weighted by the attenuation filter.

The amount of attenuation (transmission) of the optical attenuation filter is appropriately selected so as to agree with the value of the optimum potential Vcom set by visual examination. In particular, the positions of the optical sensors are first determined. Then, the potential Vcom is set to its optimum value by visual examination. At this time, the waveform observed on the oscilloscope 21, or the resulting waveform of the output signals from-the optical sensors, is any one of the waveforms at (a), (b), (d), and (e) of FIG. 4. If each optical attenuation filter for an optical filter is replaced by another, the observed waveform moves along the time axis according to the amount of attenuation of the attenuation filter. These attenuation filters are searched for one that gives the observed waveform shown at (c) of FIG. 4, and this attenuation filter is adopted.

In embodiment 3, an image-adjusting system that permits the potential Vcom to be brought into exact agreement with an optimum potential Vcom obtained by visual examination can be fabricated. Furthermore, an adjustment for minimizing flicker can be made while well coping with liquid crystal displays having various Vcom distribution characteristics, by fine-adjusting the optical attenuation filters.

Embodiment 4

Figure 9:
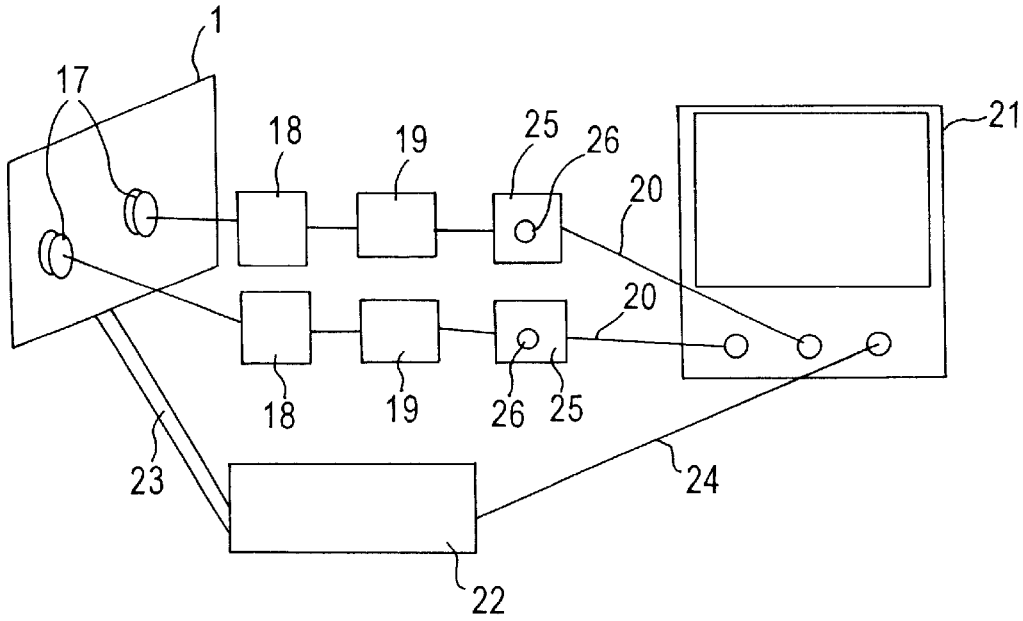
FIG. 9 is a block diagram of an image quality-adjusting system in accordance with embodiment 4 of the invention.
Figure 10:
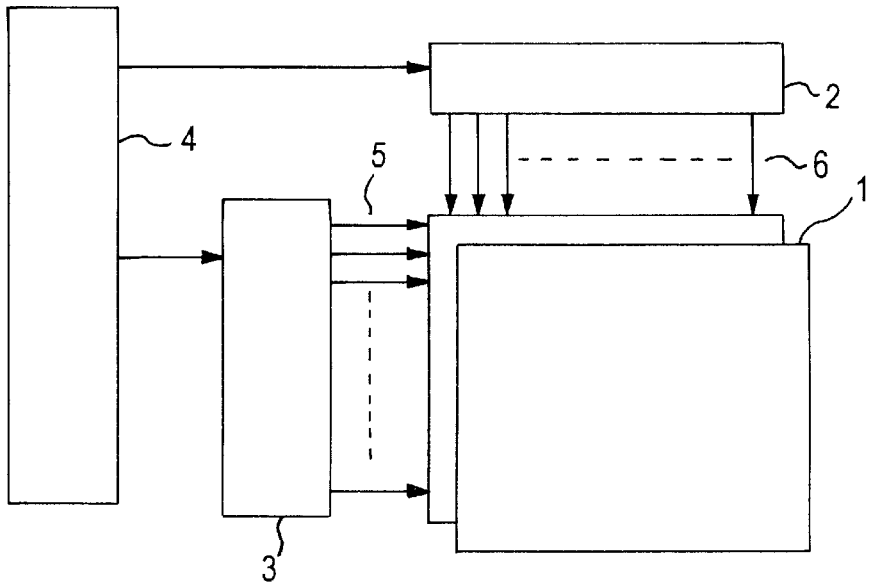
Fig. 10 PRIOR ART
FIG. 10 is a block diagram of the driver circuit of the prior art liquid crystal display.

FIG. 9 is a block diagram of an image-adjusting system in accordance with embodiment 4 of the invention. This system shown in FIG. 9 has components 1, 17–24 that are identical with their respective counterparts 1, 17–24 shown in FIG. 1. In addition, the system has an attenuation circuit 25 mounted on the output side of the band-pass filter 19 and a variable resistor 26 forming the attenuation circuit. This attenuation circuit 25 attenuates the flicker signal 20 at a constant rate.

In embodiment 3, the outputs from the plural optical sensors are weighted by the optical attenuation filters. In embodiment 4, no optical attenuation filters are mounted. Instead, amplifiers 18 are respectively connected with the outputs of the optical sensors as shown in FIG. 9. Attenuation circuits 25 are connected with the amplifiers 18, respectively, to attenuate the output signals from the amplifiers 18 at a constant rate. Thus, the optical sensors 17 are weighted.

The attenuation factor can be adjusted at will with the variable resistor 26. The attenuation factor is set in the manner described below.

The positions of the optical sensors 17 are determined, and then the potential Vcom is set to its optimum value Vcom by visual examination. At this time, the waveform (the combination of the output signals from the plural optical sensors) observed on the oscilloscope 21 is any one of the waveforms shown at (a), (b), (d), and (e) of FIG. 4. The variable resistor 26 is adjusted while monitoring the observed waveform. The observed waveform is moved along the time axis. The position of the variable resistor is fixed when the waveform shown at (c) of FIG. 4 is obtained.

In embodiment 4, an adjustment for minimizing flicker can be made while well coping with liquid crystal displays having various Vcom distribution characteristics, by fine-adjusting the attenuation factors determining the weights attached to the optical sensors such that the potential agrees with the optimum potential Vcom obtained by visual examination.

Since the present invention is configured as described thus far, it yields the following advantages.

It comprises at least one optical sensor for producing an electrical signal corresponding to the amount of light impinging on the sensor and an oscilloscope for observing the waveform of the electrical signal produced from the optical sensor in synchronism with a vertical synchronizing signal that is synchronized to odd frames or even frames. The optical sensor is placed opposite to a given location on a liquid crystal panel. The potential applied to the common electrode of the liquid crystal display is set to a sufficiently high value to observe a first waveform on the oscilloscope. The potential applied to the common electrode is set to a sufficiently low value to observe a second waveform on the oscilloscope. The potential on the common electrode of a liquid crystal display to be adjusted is so adjusted that a waveform derived from the liquid crystal display and observed on the oscilloscope has a phase midway between the phase of the first waveform and the phase of the second waveform. The potential applied to the common electrode to minimize flicker can be set with high accuracy and high reproducibility.

In one aspect of the invention, the aforementioned at least one optical sensor is plural. The resultant waveform of the electrical signals from the optical sensors is observed on the oscilloscope and so the potential applied to the common electrode to minimize flicker can be set with higher accuracy.

In another aspect of the invention, the plural optical sensors are placed on the same scanning signal line. Therefore, the potential can be set according to the distribution of the optimum common-electrode potential within the viewing screen.

The optical sensors are placed at least in the first measurement point and in the second measurement point. In the first measurement point, an adjusted value greater than a previously adjusted value of the potential applied to the common electrode is obtained, the previously adjusted value being derived by visual examination and adjustment. In the second measurement point, an adjusted value less than the previously adjusted value is obtained. Consequently, the potential applied to the common electrode can be set in such a way that the value agrees with the value obtained by visual examination and adjustment.

At least one of the optical sensors detects the amount of light impinging on it via an optical attenuation filter. Therefore, the potential applied to the common electrode can be adjusted according to the characteristics of the liquid crystal display.

As one feature of the invention, an attenuation circuit is connected with the output of at least one of the optical sensors. This makes it possible to adjust the potential on the common electrode according to the characteristics of the liquid crystal display.

As another feature of the invention, the attenuation circuit has a variable attenuation factor. In consequence, the attenuation factor of the attenuation circuit can be fine-adjusted.

The present invention also provides an image-adjusting method for a liquid crystal display, the method involving four process steps. In the first step, a potential applied to the common electrode is set to a sufficiently high value. Electrical signals produced from optical sensors placed opposite to a given location on the liquid crystal panel are observed as a first waveform on the oscilloscope in synchronism with a vertical synchronizing signal that is synchronized to odd frames or even frames. In the second step, the potential applied to the common electrode of the liquid crystal display is set to a sufficiently low value, and the electrical signals from the optical sensors are observed as a second waveform on the oscilloscope. In the third step, the optical sensors are placed opposite to a given location on the liquid crystal panel of a liquid crystal display to be adjusted. In the fourth step, the potential applied to the common electrode is so adjusted that the electrical signals which are produced from the optical sensors located opposite to the liquid crystal display to be adjusted and observed on the oscilloscope has a phase midway between the phase of the first waveform and the phase of the second waveform. In consequence, the potential applied to the common electrode to minimize flicker can be set with high accuracy and high reproducibility.

What is claimed is:

1. An image quality-adjusting system for a liquid crystal display having a liquid crystal panel consisting a first substrate, a second substrate located opposite to said first substrate, and a liquid crystal material sandwiched between said first and second substrate, said first substrate having switching elements located at intersections of scanning signal lines and display signal lines thereon, said first substrate having pixel electrodes connected with said switching elements, said second substrate having a common electrode thereon, said image quality-adjusting system comprising:

at least one optical sensor located opposite to a given location on said liquid crystal panel and producing an electrical signal corresponding to the amount of light impinging on the sensor;

an oscilloscope for observing a waveform of the electrical signal from said optical sensor in synchronism with a vertical synchronizing signal that is synchronized to odd frames or even frames; and means responsive to an operator input for applying to the common electrode of said liquid crystal display, in succession, (1) a sufficiently high value to produce a first waveform on said oscilloscope for observation by the operator, (2) a sufficiently low value to produce a second waveform on said oscilloscope for observation by the operator, wherein (1) and (2) are applied in either order, and (3) a variable potential to the common electrode to be adjusted by the operator in such a way that a waveform observed on said oscilloscope has a phase midway between a phase of said first waveform and a phase of said second waveform.

2. The image quality-adjusting system of claim 1, wherein said at least one optical sensor is plural, and wherein a resulting waveform of electrical signals produced from said plural optical sensors is observed on said oscilloscope.

3. The image quality-adjusting system of claim 2, wherein said plural optical sensors are placed on an identical scanning signal line.

4. The image quality-adjusting system of claim 2, wherein said plural optical sensors are respectively placed in a first measurement point, where an adjusted value greater than an adjusted value of the potential applied to the common electrode previously obtained by visual examination and adjustment is obtained, and in a second measurement point, where an adjusted value smaller than the previously adjusted value applied to the common electrode is obtained.

5. The image quality-adjusting system of claim 2, wherein at least one of said plural optical sensors detects the amount of light impinging thereon via an optical attenuation filter.

6. The image quality-adjusting system of claim 2, wherein an attenuation circuit is connected with the output of at least one of said plural optical sensors.

7. The image quality-adjusting system of claim 6, wherein said attenuation circuit has a variable attenuation factor.

8. A method of adjusting image quality of a liquid crystal display including a liquid crystal panel having a common electrode by adjusting a potential applied to the common electrode, said method comprising the steps of:

setting the potential applied to the common electrode to a sufficiently high value such that an electrical signal produced from at least one optical sensor located opposite to a given location on the liquid crystal panel is observed as a first waveform on an oscilloscope in synchronism with a vertical synchronizing signal that is synchronized to odd frames or even frames;

setting the potential applied to the common electrode of the liquid crystal display to a sufficiently low value such that the electrical signal produced from the optical sensor is observed as a second waveform on said oscilloscope;

placing said optical sensor opposite to the given location on a liquid crystal panel to be adjusted; and adjusting the potential applied to the common electrode such that the waveform of the electrical signal from the optical sensor opposite to the liquid crystal display to be adjusted has a phase midway between phase of said first waveform and phase of said second waveform.

* * * * *